United States Patent [19]

Zimmermann

[11] 4,205,505

[45] Jun. 3, 1980

[54] TRAY FORMING DEVICE FOR A PLURALITY OF ARTICLES, SUCH AS TEA BAGS

[75] Inventor: Helmuth Zimmermann, Karlsruhe, Fed. Rep. of Germany

[73] Assignee: Industrie-Werke Karlsruhe Augsburg Aktiengesellschaft, Fed. Rep. of Germany

[21] Appl. No.: 939,225

[22] Filed: Sep. 5, 1978

[30] Foreign Application Priority Data

Sep. 7, 1977 [DE] Fed. Rep. of Germany ... 7727661[U]

[51] Int. Cl.[2] ..... B65B 35/30; B65B 11/00

[52] U.S. Cl. ..... 53/543; 53/157; 53/590

[58] Field of Search ..... 53/156, 157, 537, 542, 53/543, 580, 190

[56] References Cited

U.S. PATENT DOCUMENTS

| | | | |
|---|---|---|---|
| 983,421 | 2/1911 | Beuini | 53/157 |
| 2,979,489 | 10/1956 | Brown et al. | 53/590 |

*Primary Examiner*—John Sipos

*Attorney, Agent, or Firm*—McGlew and Tuttle

[57] ABSTRACT

A device for aligning a plurality of rows of articles, such as tea bags, on a receiving tray for subsequent packaging in a container, comprises, means for feeding a sheet of the material along a feed path. A first row of the articles is then aligned over the top of the sheet and a loop is formed directly adjacent the trailing edge of the row of articles using a first loop-forming arm which moves upwardly through the feed path to deflect the sheet upwardly into a loop behind the first row of articles and a second arm which moves downwardly behind the upwardly deflected sheet so as to form the other side of the loop. The tray thus formed includes a plurality of substantially parallel, spaced apart loops which are formed upwardly in the bottom of the sheet material.

6 Claims, 5 Drawing Figures

9
2
3
14
5
6
7
1b
2
2'
1a
4
8
4a
1

9
4
2
16
6
3
1b
2
2'
5
8
7
1a
4a 10
3
1b
2
2'
18
2''
4
1a

TRAY FORMING DEVICE FOR A PLURALITY OF ARTICLES, SUCH AS TEA BAGS

FIELD AND BACKGROUND OF THE INVENTION

This invention relates to packaging devices in general and, in particular, to a new and useful device for the simultaneous multiple-row arrangement and preparatory transfer of receptacles filled with packing material, such as tea bags, etc., to a larger repackaging unit, such as a carton, tray or can.

DESCRIPTION OF THE PRIOR ART

The rapid, safe and neat packing, particularly of foods and stimulants, is of great importance. If several juxtaposed rows of identical packages, i.e., tea bags, etc., are placed into a larger repackaging unit, for example, problems arise in that either intermediate webs have to be provided in the repackaging unit so that the tea bags of the individual rows remain fixed, or special inserts are necessary for the individual rows.

Both intermediate webs and inserts meet the requirements, but they are relatively expensive, particularly since their manufacture and partly also their arrangement in a receptacle requires special tools and/or equipment.

SUMMARY OF THE INVENTION

The present invention provides a device which fixes and spaces several juxtaposed rows of identical packages rapidly, safely and neatly and in a simple and inexpensive manner. The packages are speced from each other in rows so that they can be subsequently transferred without difficulties into a larger repackaging unit.

According to the invention, the paper tray is made by unwinding a sheet or tape continuously from a roll and forming loops between individual receptacle rows arranged substantially parallel and side-by-side. The paper tape is folded into a narrow U-shaped loop, using mechanical means acting between each receptacle row. The sides of the loops extend substantially perpendicular to the base, but slightly diverging in the direction of its opening.

In a meaningful realization of this idea carrying the proposed invention, mechanical means are suggested which comprise two folding switches or arms arranged in tandem in the feeding direction of the paper tape and mounted rotatably transverse to the feed direction. One of the arms is additionally subjected to an ascending movement in a direction perpendicular to the feeding movement of the paper tape, during which it effects the formation of the U-shaped loop, together with the second folding arm, which moves downwardly over the tape.

According to another feature of the invention, the rotary movement of the folding arms is in the same direction as the formation of the loop of tape.

Another feature of the suggested invention is characterized in that the folding arm moving perpendicularly to the feeding movement of the paper tape is associated with a tongue or shoulder, which serves as an outer support for the folding arm during the formation of the U-shaped loop.

Finally, the suggested invention is supplemented and complemented by the fact that the tongue or shoulder is arranged perpendicularly to the feeding movement of the paper tape, but is opposite to the perpendicularly moving folding arm.

The suggested invention has a number of advantages, namely, instead of requiring relatively costly ribs as separators, intermediate webs or inserts are used which are formed in a simple manner from a paper tape. In addition, U-shape loops are formed as a continuous stiffening by means of a folding device which is relatively inexpensive to produce, while being simple and safe in construction and operation. Due to these loops, the individual package rows are sufficiently spaced from each other, depending on the size of the repackaging unit, and are also fixed laterally so that they can be subsequently transferred without any difficulties to the repackaging unit.

Accordingly, it is an object of the invention to provide a device for preparing a plurality of articles, such as tea bags, for assembly into a larger container, which includes means for feeding a sheet of material, such as paper, along a feed path, deflecting the paper upwardly to form a first wall of a loop which forms a boundary wall for a first row of the articles, and thereafter, deflecting the material behind the upwardly deflected portion downwardly to form the second wall of a loop so as to have loop separators formed between rows of the articles.

A further object of the invention is to provide a receiving tray for packaging materials in a container which includes a web of sheet material having a bottom with loops formed upwardly in the bottom at spaced parallel locations so as to define separating walls for rows of articles arranged on the material between the loops.

Another object of the invention is to provide a device for forming individual article packaging trays which is simple in design, rugged in construction and economical to manufacture.

For an understanding of the principles of the invention, reference is made to the following description of a typical embodiment thereof as illustrated in the accompanying drawings.

DESCRIPTION OF THE PREFERRED EMBODIMENT

Figure 1:
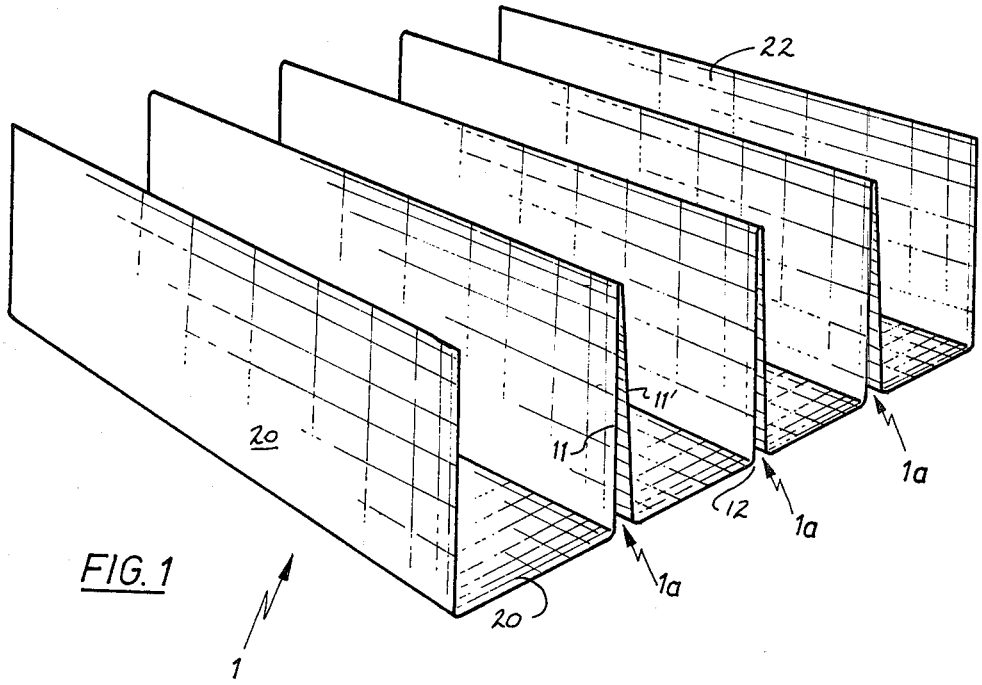
FIG. 1 is a front top perspective view of a paper tape provided with several paraxial U-shape loops.
Figure 2:
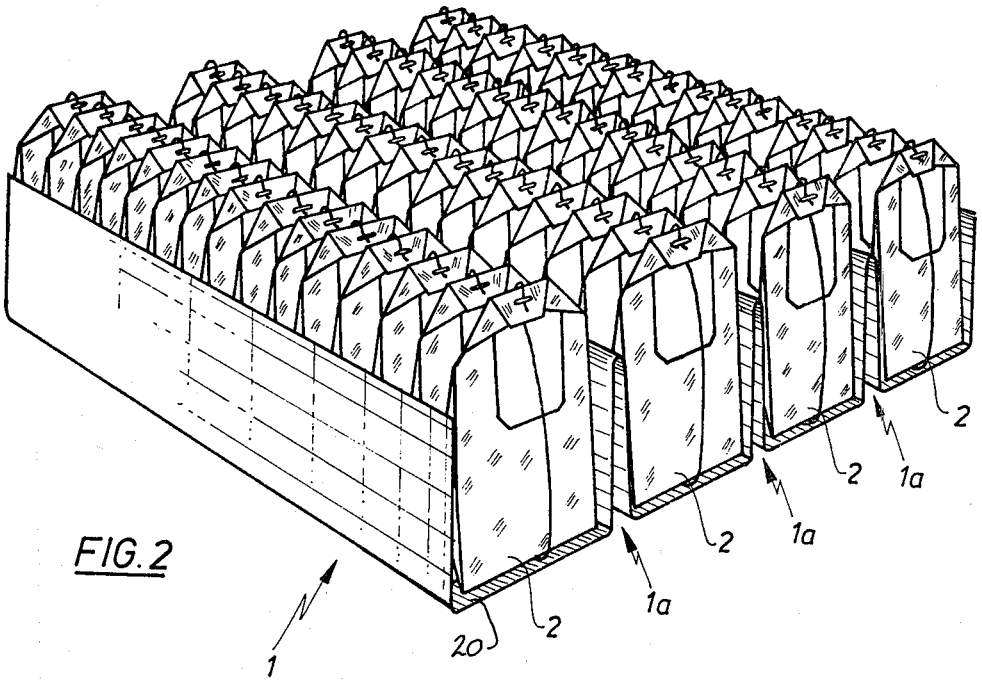
FIG. 2 is a view corresponding to FIG. 1 with the tape filled with several paraxial tea bags, etc.

Referring to the drawings in particular, the invention embodied therein as indicated in FIGS. 1 and 2, comprises a tray or support, generally designated 1, made of a material such as paper tape, and which includes a bottom 20 which has a plurality of loop formations, generally designated 1*a*, which are formed inwardly of the bottom 20 at spaced parallel locations along the entire length thereof. In the embodiment shown, the tray 1 includes upright walls 20 and 22 at the respective sides.

The paper tape 1 is made, as shown in the embodiment of FIGS. 1 and 2, for example, with four tea bag rows 2 arranged paraxially to each other. However, the number of rows is variable within wide limits, depending on the respective intended use and/or the geometry of the repackaging unit.

The U-shaped loops 1*a* impart a certain amount of stiffness to the paper tape and they are arranged substantially perpendicular to the respective base, with sides 11 and 11' slightly diverging downwardly toward a bottom loop opening 12.

Figure 3:
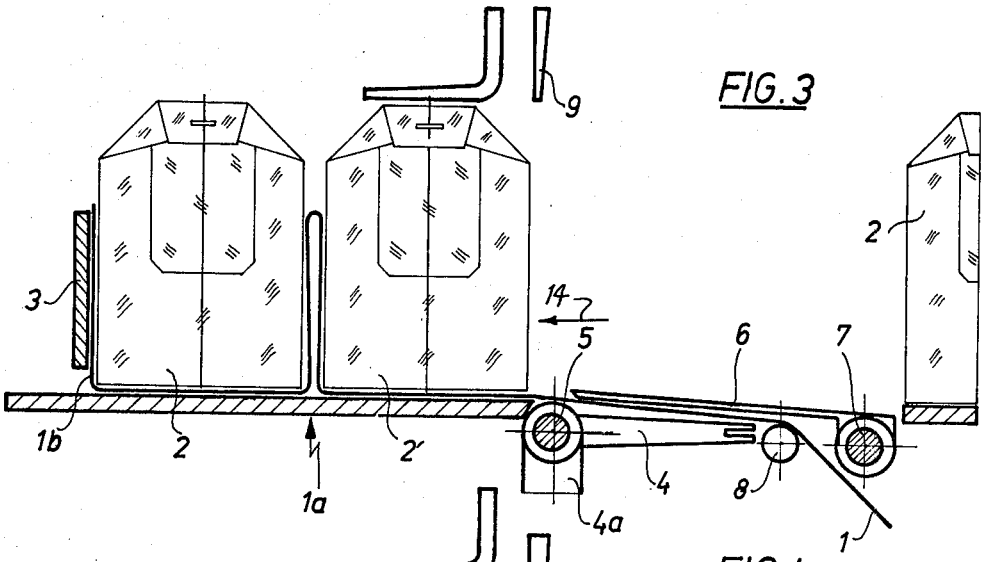
FIG. 3 is a schematic longitudinal sectional view of a device for producing the U-shape folds, constructed in accordance with the invention.

FIG. 3 shows two tea bag rows 2, 2' which are spaced from each other by a U-shaped loop 1*a*, with the first or left row being fixed geometrically by an upright side wall 1*b* of a sheet or tape 1 made of a material, such as paper. During the folding operation in paper tape 1, side wall 1*b* bears on an abutment or shoulder 3 which moves or is indexed to the left by an amount corresponding to the program of the folding operation and the filling with filling material.

A first folding arm or switch 4 has one end rotatably mounted on point or pivot 5 which is rotated by means not shown, and a second folding arm or switch 6 is rotatably mounted on point or pivot 7. Both of the pivots 5 and 7 are arranged transverse to the feeding direction 14 of the paper tape 1. Folding switch 4 continues below its fulcrum 5 as a lever 4*a*, which can be shifted up and down and which is in operative connection with mechanisms which do not belong to the invention and are therefore not represented. Roller 8 serves to deflect and guide paper tape 1 which, in turn, is continuously unwound from a roll, which is also not shown.

Figure 4:
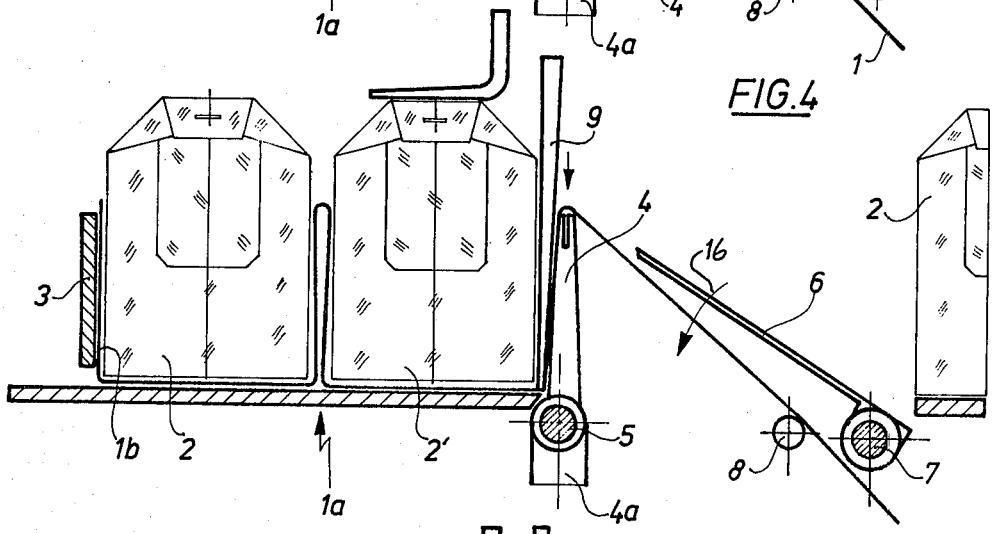
FIG. 4 is a view, similar to FIG. 3, but with the mechanism shown during the folding.
Figure 5:
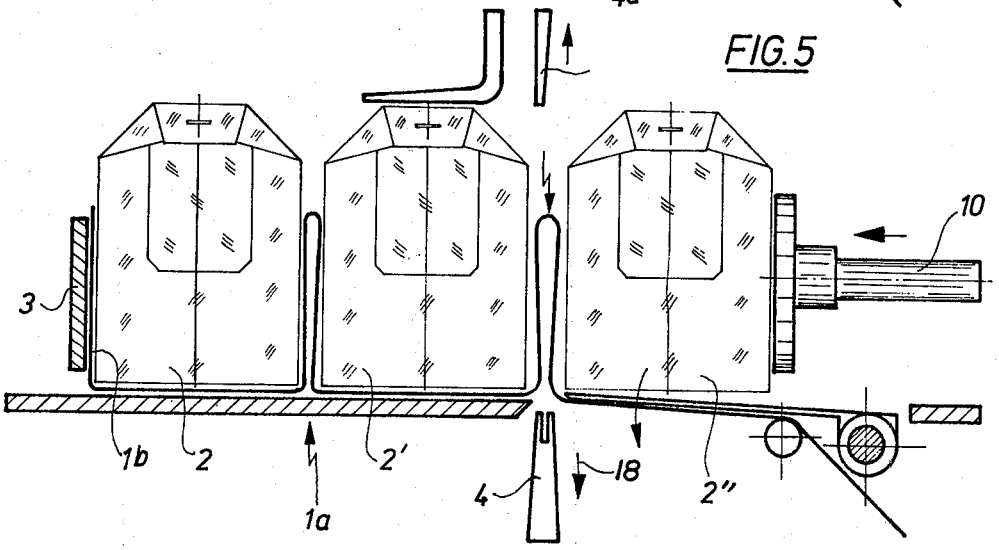
FIG. 5 is a view similar to FIG. 3, but with the mechanism shown after the folding. but before the next tea bag row is shoved off.

In FIG. 4, the folding arms 4 and 6 are shown just about in a position to form a new U-shaped loop 1*a*. A tongue or tucking blade 9 is mounted so as to move upwardly and downwardly perpendicularly to the feeding direction 14 of the paper 1. The tongue 9 serves as an outer support for folding arm 4 in its bottom position represented in FIG. 4. The tape 1 is arranged between the tongue 9 and the first arm 4, and the second arm 6 moves in the direction of the arrow 16, in FIG. 4, and then downwardly and effects the unwinding of additional tape material when it comes into contact with paper tape 1. This movement also effects the formation of the next U-shape loop 1*a*, seen in FIG. 5. After the formation of the loop, the tongue 9 moves upwardly again while folding arm 4 moves in the opposite direction, as shown by the arrow 18, downwardly to return to the position according to FIG. 3. At the same time, the next tea bag row 2 is pushed by means of a slide 10 toward the previously formed U-shape loop 1*a*.

Without departing from the principle of a U-shape loop, the loop formation can also be effected with other suitable mechanical means.

While a specific embodiment of the invention has been shown and described in detail to illustrate the application of the principles of the invention, it will be understood that the invention may be embodied otherwise without departing from such principles.

What is claimed is:

1. A device for aligning a plurality of rows of articles on a receiving tray made of sheet material with a plurality of loops between the rows of the articles, comprising, means for feeding a sheet of material along a feed path, means for positioning a first row of the articles on the sheet of materials, a first loop-forming arm disposed substantially parallel to said feed path and having one end pivotally mounted alongside said feed path and having an opposite end, means for moving said opposite end from a position extending in a direction opposite to the feed direction of the material and substantially parallel to said feed path, upwardly through the feed path, to a position substantially perpendicular to said feed path and to deflect the sheet of material upwardly so as to form one side of a first loop alongside the first row of the articles, a guide over which the sheet material is fed spaced from said opposite end of said first loop-forming arm in a direction opposite to the feed direction of said sheet material, a second loop-forming arm disposed on the opposite side of said guide from said first loop-forming arm and having a first end remote from said first loop-forming arm pivotally mounted adjacent said feed path on the opposite side thereof from said first arm and having an opposite end, said second arm being movable from a position substantially parallel to and everlying said sheet material upwardly with upward movement of said first loop-forming arm and then downwardly to deflect the sheet material portion following the portion engaged by said first arm downwardly toward the feed path to form the opposite side of said loop, said positioning means placing another row of articles on said sheet adjacent the opposite side of said loop.

2. A device, as claimed in claim 1, including a tucker member movable in a downward direction toward said feed path and insertable between the articles and the portion of the sheet material lifted upwardly by said first loop-forming arm to aid in the effecting of the formation of said loop.

3. A device, as claimed in claim 1, wherein said first and second arms are rotatable in the same direction of rotation during the formation of said loop.

4. A device, as claimed in claim 1, including slide means engageable with the last row of articles positioned on the sheet material to move the articles during the movement of the web along said feed path.

5. A device, as claimed in claim 1, including means for moving the pivot of said first loop-forming arm downwardly with said arm disengaging from the loop.

6. A device, as claimed in claim 1, including means overlying the articles for holding the articles on said sheet material.

* * * * *